US010797395B2

(12) United States Patent
Higaki

(10) Patent No.: US 10,797,395 B2
(45) Date of Patent: Oct. 6, 2020

(54) ANTENNA AND ANTENNA APPARATUS

(71) Applicant: KABUSHIKI KAISHA TOSHIBA, Minato-ku, Tokyo (JP)

(72) Inventor: Makoto Higaki, Tokyo (JP)

(73) Assignee: KABUSHIKI KAISHA TOSHIBA, Tokyo (JP)

( * ) Notice: Subject to any disclaimer, the term of this patent is extended or adjusted under 35 U.S.C. 154(b) by 45 days.

(21) Appl. No.: 16/291,574

(22) Filed: Mar. 4, 2019

(65) Prior Publication Data

US 2020/0083607 A1 Mar. 12, 2020

(30) Foreign Application Priority Data

Sep. 12, 2018 (JP) ..... 2018-170783

(51) Int. Cl.

| | |
|---|---|
| ***H01Q 9/04*** | (2006.01) |
| ***H01Q 9/16*** | (2006.01) |
| ***H01Q 21/29*** | (2006.01) |
| ***H01Q 21/24*** | (2006.01) |
| ***H01Q 1/36*** | (2006.01) |

(52) U.S. Cl.

CPC ..... *H01Q 9/0428* (2013.01); *H01Q 1/36* (2013.01); *H01Q 9/16* (2013.01); *H01Q 21/24* (2013.01); *H01Q 21/29* (2013.01)

(58) Field of Classification Search

CPC ..... H01Q 9/0428; H01Q 9/0435; H01Q 9/16; H01Q 9/18; H01Q 21/24; H01Q 21/29; H01Q 1/36; H01Q 1/52; G04R 60/02; G04G 21/04

See application file for complete search history.

(56) References Cited

U.S. PATENT DOCUMENTS

| | | | | |
|---|---|---|---|---|
| 6,486,848 | B1 * | 11/2002 | Poilasne | H01Q 9/16 343/797 |
| 9,647,332 | B2 * | 5/2017 | Han | H01Q 1/50 |
| 9,785,124 | B2 * | 10/2017 | Mitani | G04R 60/12 |
| 10,205,227 | B2 * | 2/2019 | Ozden | H01Q 1/243 |
| 2020/0103833 | A1 * | 4/2020 | Kita | H01Q 9/30 |

FOREIGN PATENT DOCUMENTS

JP 2004266419 A 9/2004

* cited by examiner

*Primary Examiner* — Haissa Philogene

(74) *Attorney, Agent, or Firm* — Holtz, Holtz & Volek PC

(57) ABSTRACT

An antenna as an embodiment of the present invention is provided with an exciting element and a plurality of non-exciting elements. In a plan view, the exciting element includes a central region having a feeding point and at least three extending regions that extend radially from the central region. In the plan view, each non-exciting element includes a short circuit region having a short circuit point and a power receiving region located at a position where it is allowed to be capacitively coupled with corresponding one of the extending regions. In the plan view, a current path from the short circuit region to the power receiving region in each non-exciting element has a vertical component with respect to the extending direction of the corresponding one of the extending regions.

12 Claims, 13 Drawing Sheets

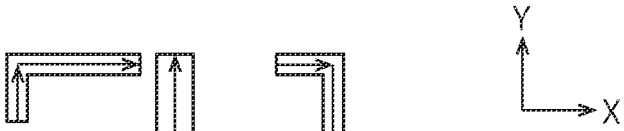
FIG. 4A
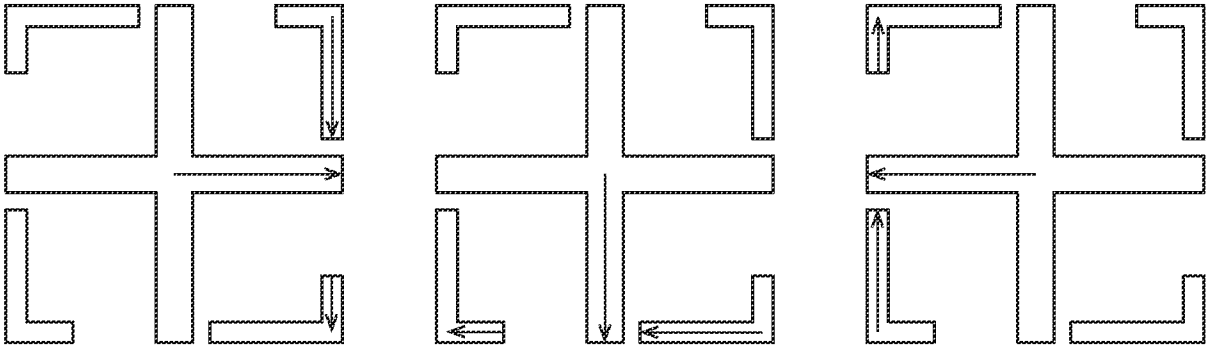
FIG. 4B
FIG. 4C
FIG. 4D
FIG. 4E

ANTENNA AND ANTENNA APPARATUS

CROSS-REFERENCE TO RELATED APPLICATION (S)

This application is based upon and claims the benefit of priority from Japanese Patent Application No. 2018-170783, filed Sep. 12, 2018; the entire contents of which are incorporated herein by reference.

FIELD

Embodiments described herein relate generally to an antenna and an antenna apparatus.

BACKGROUND

Helical antennas that radiate circularly polarized waves are widely used as antennas for wireless communication devices or the like. Such a helical antenna has a plurality of helical linear conductors (coils) arranged so as to overlap with one another. Therefore, power needs to be supplied to the plurality of linear conductors respectively. Having such a structure, manufacturing of the helical antenna involves much time and labor, and manufacturing cost and manufacturing accuracy become matters of concern.

BRIEF DESCRIPTION OF THE DRAWINGS

FIGS. 4A to 4E are schematic views of a current distribution for describing generation of a circularly polarized wave;

DETAILED DESCRIPTION

An embodiment of the present invention provides an antenna capable of radiating circularly polarized waves and simpler than a helical antenna.

An antenna as an embodiment of the present invention is provided with an exciting element and a plurality of non-exciting elements. In a plan view, the exciting element includes a central region having a feeding point and at least three extending regions that extend radially from the central region. In the plan view, each non-exciting element includes a short circuit region having a short circuit point and a power receiving region located at a position where it is allowed to be capacitively coupled with corresponding one of the extending regions. In the plan view, a current path from the short circuit region to the power receiving region in each non-exciting element has a vertical component with respect to the extending direction of the corresponding one of the extending regions.

Below, a description is given of embodiments of the present invention with reference to the drawings. The present invention is not limited to the embodiments.

First Embodiment

Figure 1:
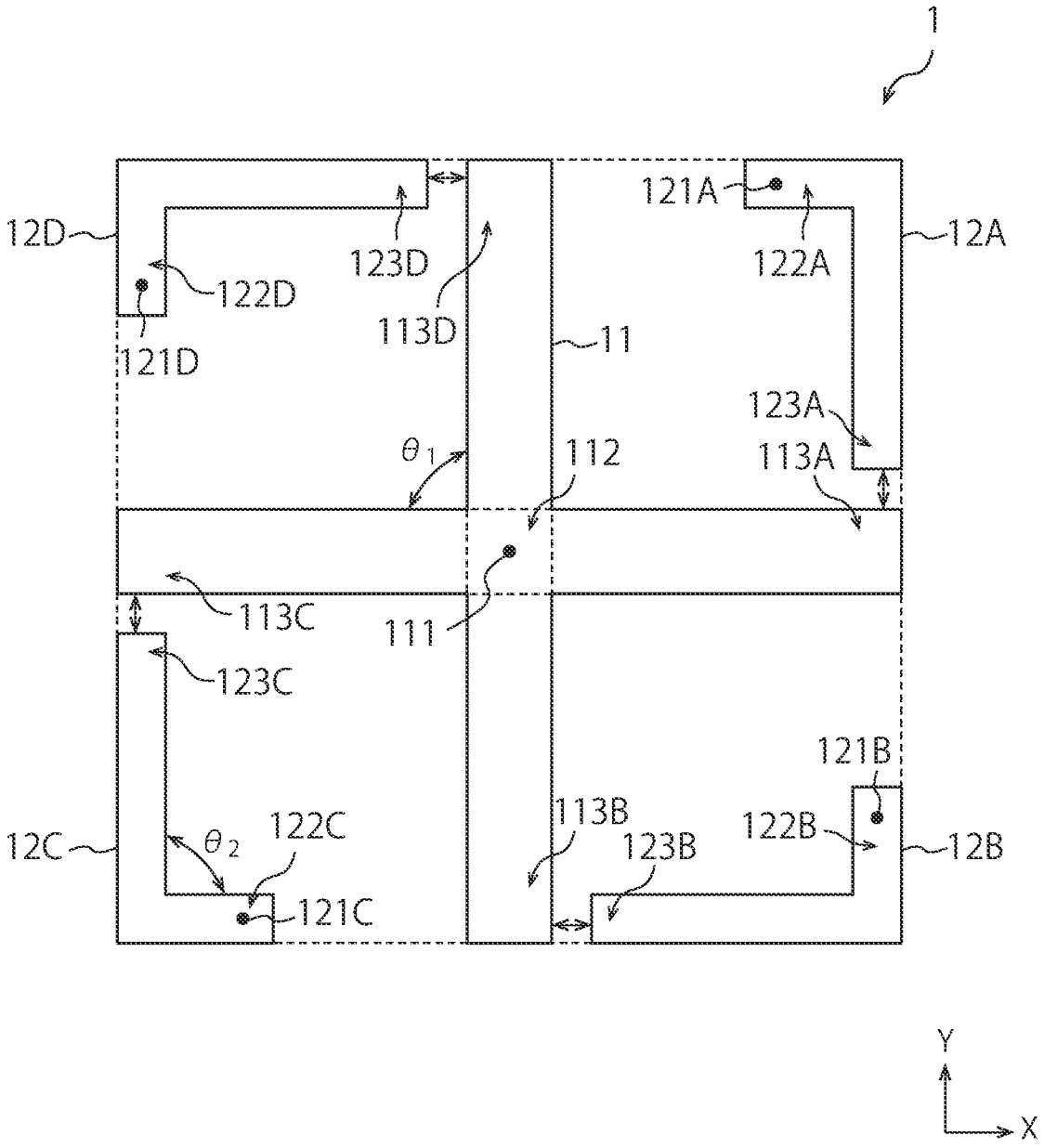
FIG. 1 is a plan view illustrating an example of a schematic configuration of an antenna according to a first embodiment.

FIG. 1 is a plan view illustrating an example of a schematic configuration of an antenna according to a first embodiment. An antenna 1 according to the first embodiment is provided with an exciting element (feeding antenna) 11 and a plurality of non-exciting elements (parasitic antennas) 12. The exciting element 11 includes a central region 112 having a feeding point 111 and at least three extending regions 113 that extend radially from the central region 112. Each non-exciting element 12 includes a short circuit region 122 having a short circuit point 121 and a power receiving region 123 located at a position where it is allowed to be capacitively coupled with the corresponding extending region 113.

Each of the aforementioned regions is a planar region in the same plan view. It should be noted that description of each region is description in the plan view unless otherwise specified.

In the present description, a plurality of components are distinguished based on alphabetical suffixes to reference numerals. In the example in FIG. 1, there are four non-exciting elements 12 of 12A, 12B, 12C and 12D. Similarly, there are extending regions 113 of 113A to 113D, short circuit points 121 of 121A to 121D, short circuit regions 122 of 122A to 122D and power receiving regions 123 of 123A to 123D. Incidentally, the extending regions 113 have a one-to-one correspondence with the non-exciting elements 12, and the corresponding extending regions 113 and non-exciting elements 12 are assigned identical alphabets.

The exciting element 11 is a conductor excited by being fed with power from a feeding circuit or the like. In other words, the exciting element 11 is a conductor excited with a high frequency current being applied thereto. Hereinafter, a "current" means a high-frequency current unless otherwise specified.

The central region 112 is defined as a region around a center of the exciting element 11. Since the plurality of extending regions 113 extend radially from the central region 112, the central region 112 can also be referred to as a crossing region of the extending regions 113. A current from the feeding circuit is fed thereinto from the center. Therefore, the central region 112 has the feeding point 111 and the feeding point 111 is located in the center of the central region 112. Normally, the central region 112 is assumed to have a polygonal shape corresponding to the number of extending regions 113, but may also have a circular shape.

Suppose there are at least three extending regions 113. In the example in FIG. 1, there are four extending regions 113 and the exciting element 11 has a cross-like shape. Incidentally, in FIG. 1, the angles ($\theta_1$ in FIG. 1) between the extending regions 113 are the same, but the angles need not always be the same when directivity of the antenna 1 is not taken into consideration.

Each non-exciting element 12 is a conductor that generates a current through capacitive coupling with any one of the extending regions 113. The extending regions 113 have a one-to-one correspondence with the non-exciting elements 12. That is, there is only one non-exciting element 12 that is capacitively coupled with one extending region 113. Each non-exciting element 12 is disposed at a position where it is allowed to be capacitively coupled with the corresponding extending region 113. In other words, a distance between the non-exciting element 12 and the extending region 113 nearest to the non-exciting element 12 is a distance that allows both elements to be capacitively coupled. The end region in the non-exciting element 12 nearest to the extending region 113 is the power receiving region 123.

Incidentally, capacitive coupling preferably takes place at an end of the extending region 113. In other words, the power receiving region 123 is preferably located adjacent to the end of the corresponding extending region 113.

Furthermore, the non-exciting elements 12 have their respective short circuit points 121. The short circuit regions 122 are defined as regions around the short circuit points 121. Suppose that the short circuit regions 122 are sufficiently apart from the extending regions 113 and the power receiving regions 123 so as to prevent the short circuit regions 122 from affecting the respective currents flowing through the exciting element 11. Incidentally, the short circuit regions 122 are intended to facilitate the description of the non-exciting elements 12, and the size or the like of the short circuit regions 122 may be freely defined. Assuming that there is a connection region between the short circuit region 122 and the power receiving region 123, the non-exciting element 12 may be divided into the short circuit region 122, the connection region and the power receiving region 123.

A current generated in the non-exciting element 12 through capacitive coupling flows from the short circuit region 122 to the power receiving region 123. The shape and disposition of the non-exciting element 12 are defined so that the current flowing through the non-exciting element 12 has a component perpendicular to the extending direction of the corresponding extending region 113 (vertical component). In other words, the shape of the non-exciting element 12 in the aforementioned plan view is not particularly limited if only the current path from the short circuit region 122 to the power receiving region 123 has a vertical component with respect to the extending direction of the corresponding extending region 113. On the contrary, if the whole shape of the non-exciting element 12 is parallel to the extending direction of the corresponding extending region 113, the non-exciting element 12 is inadequate. The reason will be described later.

The current path of the non-exciting element 12 is manufactured to be ¼ of the wavelength of a radio wave to be used for the antenna 1. Therefore, if the area of the region where the non-exciting element 12 is set up is sufficiently large, the non-exciting element 12 may simply have a rectilinear shape perpendicular to the extending direction of the corresponding extending region 113. When the area is not sufficiently large or the like, the non-exciting element may have a non-linear shape. Adopting a non-linear shape for the non-exciting element improves the degree of freedom of the design of the antenna 1. In FIG. 1, although the non-exciting element 12 has an L-shape, the non-exciting element 12 may have other shapes, for example, an arcuate shape.

The antenna 1 of the present embodiment radiates a circularly polarized wave. In order to be able to radiate a circularly polarized wave, the exciting element 11 and the non-exciting elements 12 have the aforementioned shapes in a plan view and are disposed at predetermined positions. For that reason, the exciting element 11 and the non-exciting elements 12 may be formed of planar elements or three-dimensional elements. Note that, the circularly polarized wave is supposed to also include elliptically polarized wave. That is, the circularly polarized wave radiated from the antenna 1 may be elliptical.

Figure 2:
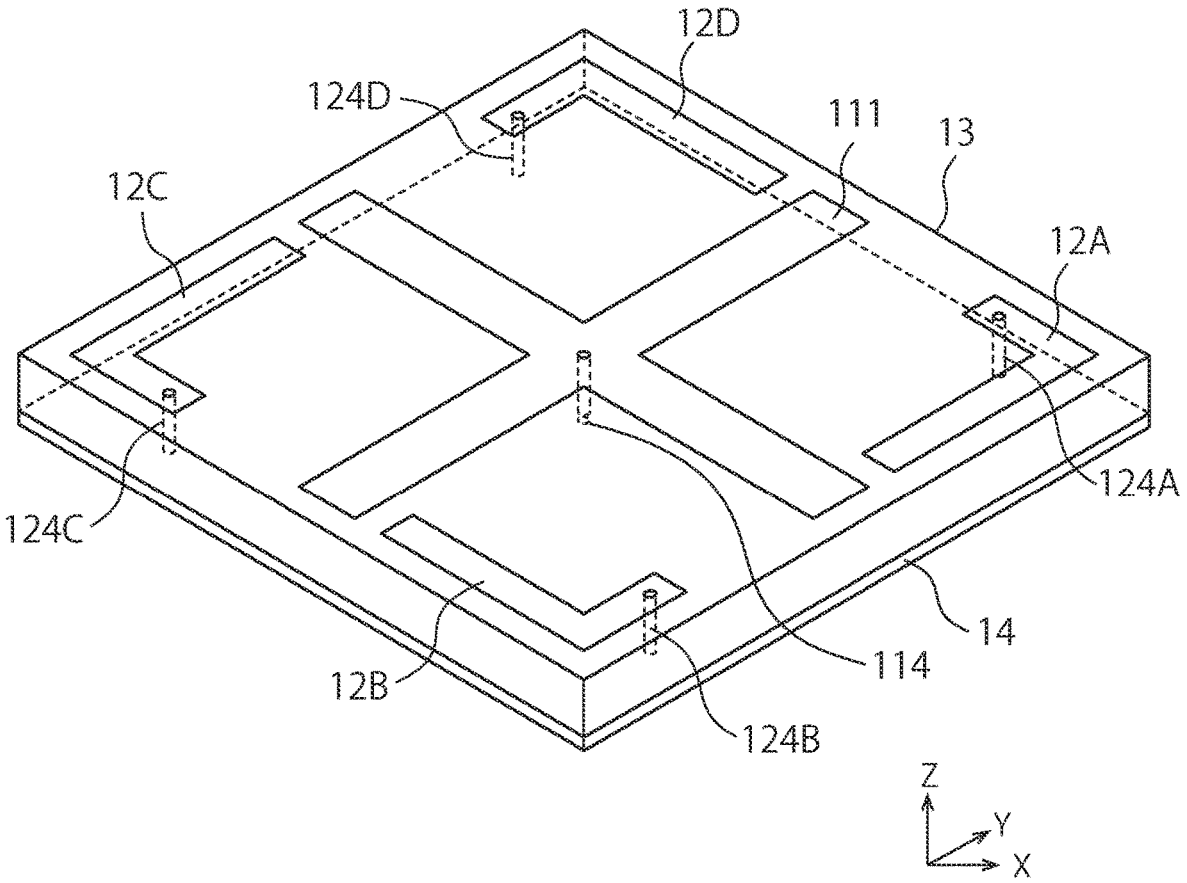
FIG. 2 is a diagram illustrating an example of a case where an exciting element and non-exciting elements are formed of planar elements.

FIG. 2 is a diagram illustrating an example of a case where exciting elements and non-exciting elements are formed of planar elements. In FIG. 2, the antenna 1 is formed on a printed circuit board. A transparent three-dimensional object represents an insulator 13. A conductor grounding plate 14 which is a conductive substrate is adhered to a bottom surface of the insulator 13. That is, in the example in FIG. 2, the insulator 13 is laminated on the conductor grounding plate 14; and the exciting element 11 and the non-exciting elements 12 are formed of strip lines formed on a top surface of the insulator 13. Furthermore, a through hole 114 is formed at the feeding point 111. A high-frequency signal can be applied to the exciting element 11 via the through hole 114. Furthermore, through holes 124 are formed at the short circuit points 121. For example, when the conductor grounding plate 14 has a grounding potential, each through hole 124 electrically connects the conductor grounding plate 14 and each short circuit point 121. This enables short circuiting at the short circuit point 121. In this way, the antenna 1 may be constructed of a printed circuit board using a planar element.

Figure 3:
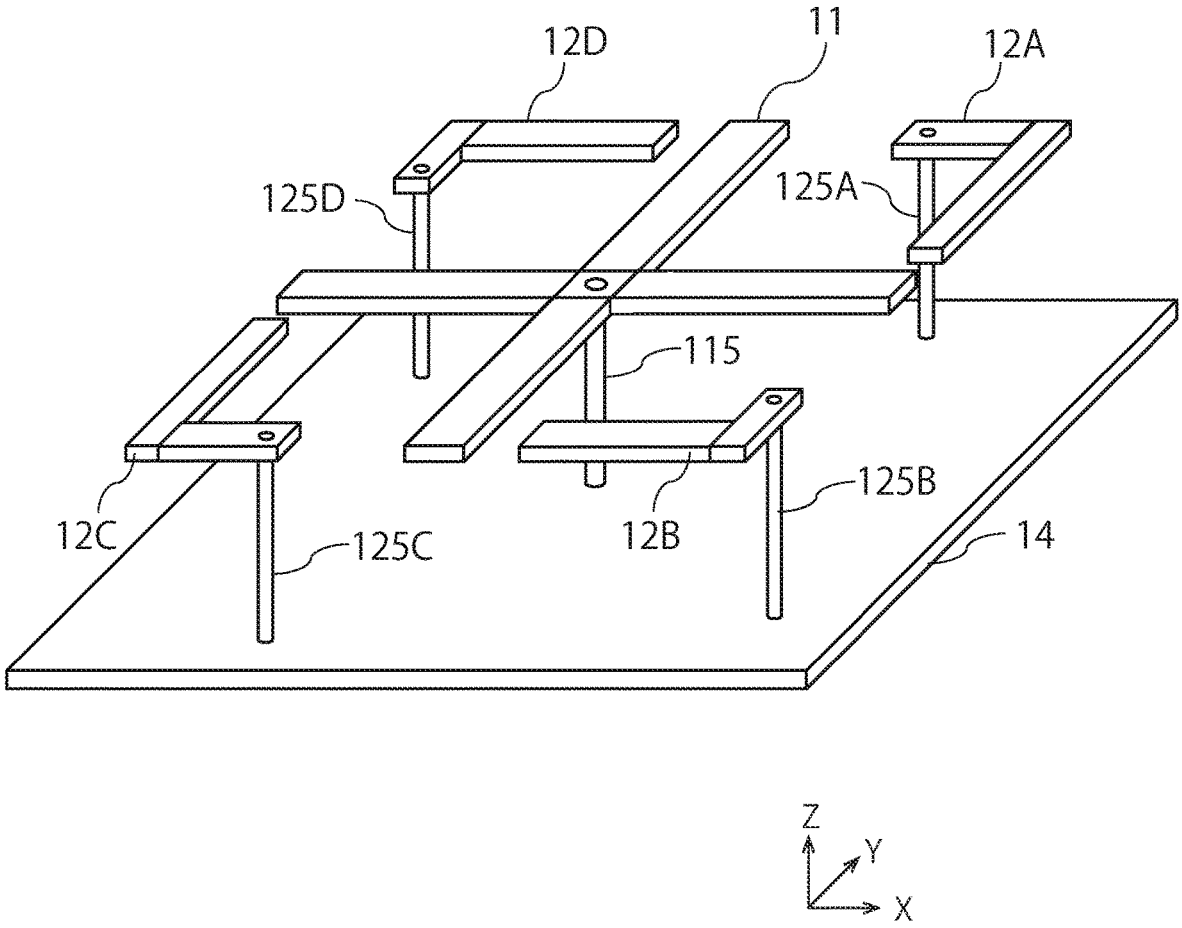
FIG. 3 is a diagram illustrating an example of a case where an exciting element and non-exciting elements are formed of three-dimensional elements.

FIG. 3 is a diagram illustrating an example of a case where an exciting element and non-exciting elements are formed of three-dimensional elements. The exciting element 11 and the non-exciting elements 12 are constructed of several conductive members (conductor plates). In the example in FIG. 3, although space between the exciting element 11 and the conductor grounding plate 14 is hollow, the exciting element 11 is supported by a support column 115. Although Space between the non-exciting elements 12 and the conductor grounding plate 14 is also hollow, the non-exciting elements 12 are supported by support columns 125. In this example, it is assumed that feeding is performed via the support column 115 and short circuit is performed via the support columns 125. Incidentally, positions in a vertical direction of the exciting element 11 and non-exciting elements 12, that is, heights need not always be equal.

In addition, for example, a configuration may also be considered in which: the exciting element 11 is constructed of four linear conductors which are bent at 90 degrees; the exciting element 11 is constructed in such a way that parts of the linear conductors become horizontal; and the remaining parts of the linear conductors become perpendicular to the horizontal surface, playing roles as support columns and feeding paths. Thus, the antenna 1 can also be formed without using a printed circuit board.

Thus, with the antenna 1 of the present embodiment, it does not matter what three-dimensional shape the exciting element 11 and the non-exciting elements 12 may have. Furthermore, the exciting element 11 and the non-exciting elements 12 may be constructed of a plurality of elements.

As described above, the extending region 113 and the power receiving region 123 are not always located on the same horizontal surface as long as the two parts can be capacitively coupled.

Next, generation of a circularly polarized wave by the antenna 1 will be described using FIGS. 4A to 4E. FIGS. 4A to 4E are schematic views of current distribution for describing generation of a circularly polarized wave. When a current is supplied at the feeding point 111, a current flowing from the central region 112 toward each extending region 113 is generated. A current is also induced at each non-exciting element 12 via capacitive coupling with the exciting element 11. Since the current becomes maximum at the short circuit point 121, the direction of the current generated in the non-exciting element 12 is a direction from the short circuit region 122 toward the power receiving region 123. Incidentally, in FIG. 4, the current generated in the non-exciting element 12 is divided into a component headed in an X-axis direction and a component headed in a Y-axis direction, and both components are represented by two arrows. In this way, currents flow through the exciting element 11 and the non-exciting elements 12 as illustrated with the arrows in FIG. 4A.

For convenience of description, these currents are classified into a plurality of groups based on directions in which the currents flow. FIGS. 4B to 4E illustrate combinations of currents of the respective groups. Currents of the extending regions 113 are classified into different groups respectively. Furthermore, currents differing by positive 90 degrees from the currents of the extending regions 113 in the flowing direction are classified into the same group as the group of the currents of the respective extending regions 113. Incidentally, an X-axis positive direction is assumed to be 0 degrees as a criterion and the flowing direction is assumed clockwise such that a Y-axis negative direction is 90 degrees, an X-axis negative direction is 180 degrees and a Y-axis direction is 270 degrees. For example, FIG. 4B illustrates a current headed in the X-axis positive direction (current flowing through the extending region 113A) and a current flowing in the Y-axis negative direction different by positive 90 degrees from the X-axis positive direction (the Y-axis direction component of the current flowing through the non-exciting element 12A and the Y-axis direction component of the current flowing through the non-exciting element 12B).

When a current flowing in the X-axis direction and a current flowing in the Y-axis direction exist, and a phase difference between these currents is 90 degrees, the sum of vectors of both currents rotates with time, and so a circularly polarized wave is generated in a Z-axis direction. Therefore, circularly polarized waves are formed from the respective groups shown in FIGS. 4B to 4E with respect to the Z-axis direction respectively. Since a radio wave generated by the antenna 1 is obtained by multiplexing these circularly polarized waves, the antenna 1 also generates a circularly polarized wave. Therefore, the antenna 1 operates as an antenna that radiates a circularly polarized wave.

In this way, a plurality of non-exciting elements 12 are provided so that currents perpendicular to the currents flowing through the respective extending regions 113 are generated. Thus, circularly polarized waves are generated from the respective extending regions 113 and a circularly polarized wave is formed by multiplexing these circularly polarized waves in the antenna 1 as a whole.

Incidentally, sizes of the exciting element 11 and the non-exciting elements 12 are adjusted in advance according to a frequency band to be used in the antenna 1 of the present embodiment, and it is also assumed that a phase difference between a current flowing through the exciting element 11 and a current flowing through each non-exciting element 12 is adjusted to be 90 degrees.

Furthermore, when the exciting element 11 and the non-exciting elements 12 are disposed rotationally symmetrically with respect to the feeding point 111, the respective extending regions 113 have equal lengths and respective current paths of the exciting elements 11 also have equal lengths. For that reason, on the straight line passing through the feeding point 111 and parallel to the vertical direction, the circularly polarized wave in FIG. 4B and the circularly polarized wave in FIG. 4D cancel each other out. Also, on the straight line, the circularly polarized wave in FIG. 4C and the circularly polarized wave in FIG. 4E cancel each other out. Therefore, directivity in the vertical direction at the feeding point 111 becomes null.

Figure 5:
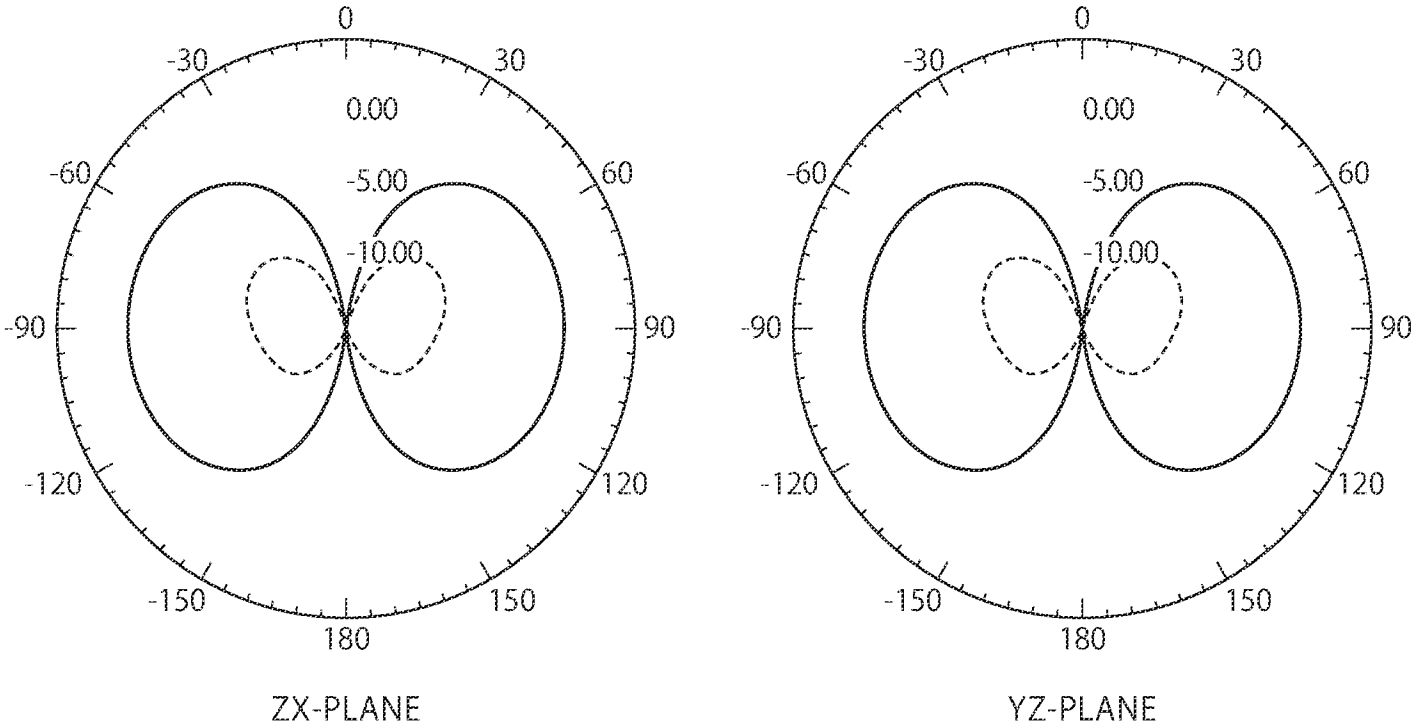
FIG. 5 is a diagram illustrating antenna directivity in a case where an antenna is rotationally symmetric.

FIG. 5 is a diagram illustrating antenna directivity in a case where an antenna is rotationally symmetric. An antenna 1 pattern on the left side represents a gain of the antenna 1 on a ZX-plane. An antenna 1 pattern on the right side represents a gain of the antenna 1 on a ZY-plane. Furthermore, a solid line graph represents a gain of a left hand circularly polarized wave, and a dotted line graph represents a gain of a right hand circularly polarized wave. A scale in the vicinity of a circumference represents an elongation from the Z-axis positive direction.

As illustrated in FIG. 5, the directivity in the Z-axis direction, that is, the directivity in the vertical direction is null. That is, when the antenna 1 is rotationally symmetric, this means that it is not possible to receive a radio wave of the antenna 1 on a straight line passing through the feeding point 111 and parallel to the vertical direction. Thus, by making the antenna rotationally symmetric in a plan view, it is possible to manufacture the antenna 1 having null directivity in the vertical direction. Hereinafter, the direction in which the gain is null will be simply described as a null direction. Incidentally, the antenna 1 still has null directivity when it is not rotationally symmetric, although the null direction deviates from the vertical direction or the null range is narrower than a case where the antenna 1 is rotationally symmetric.

Figure 6:
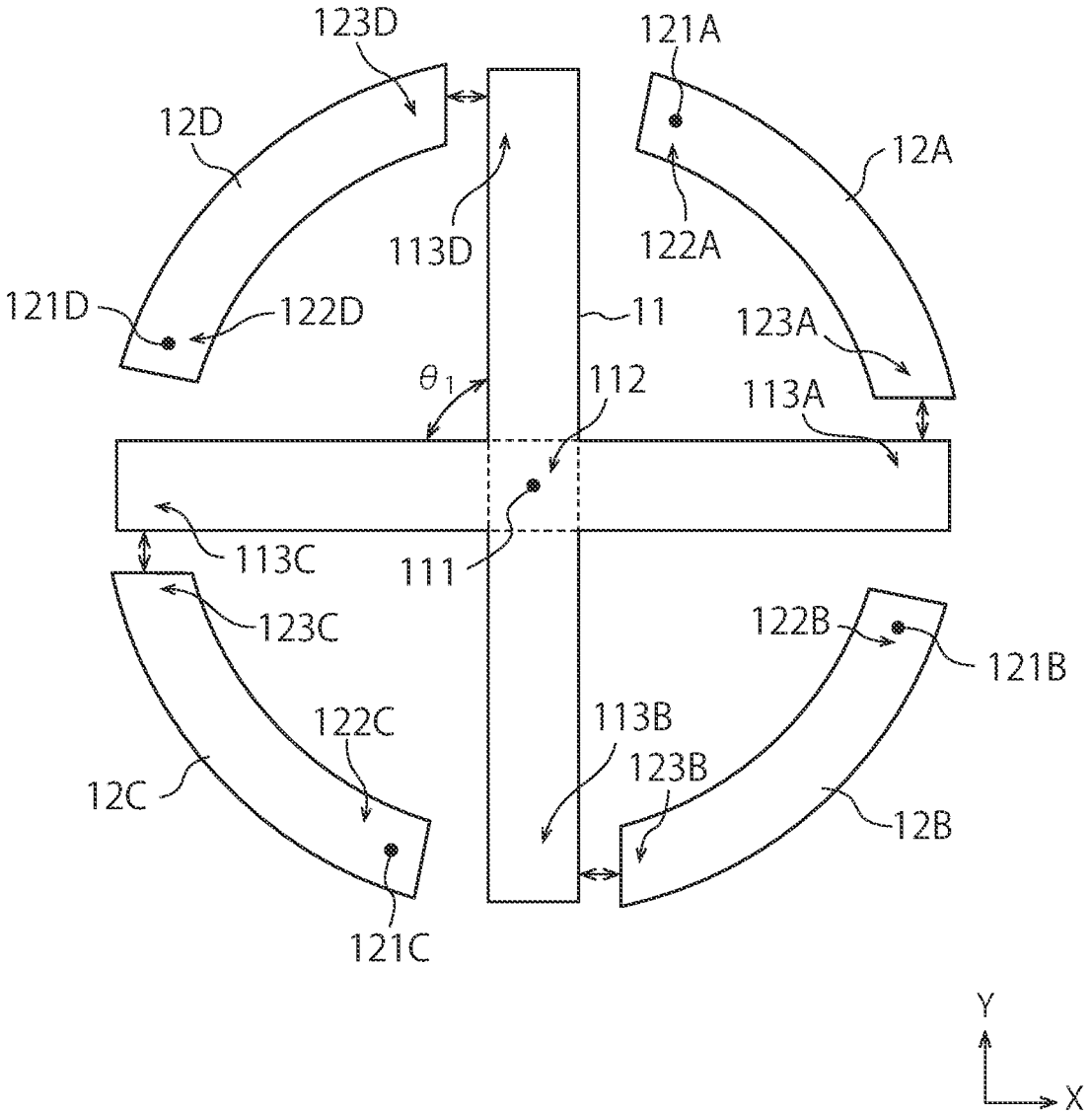
FIG. 6 is a plan view illustrating an example of a case where non-exciting elements have an arcuate shape in a plan view.

FIG. 6 is a plan view illustrating an example of a case where a non-exciting element has an arcuate shape in a plan view. In the example in FIG. 6, currents flow through the non-exciting elements 12 in an arcuate shape. However, the arcuate current can be divided into a component parallel to the extending direction and a component perpendicular to the extending direction. Since a current of the non-exciting element 12 includes a component perpendicular to the extending direction of the corresponding extending region 113, the antenna 1 can form a circularly polarized wave even when the non-exciting element 12 has an arcuate shape. Furthermore, as in the example in FIG. 6, the antenna 1 can be made rotationally symmetric by arranging arcuate non-exciting elements along the circumference centered on the feeding point 111. In this case, the antenna 1 has null directivity.

Figure 7:
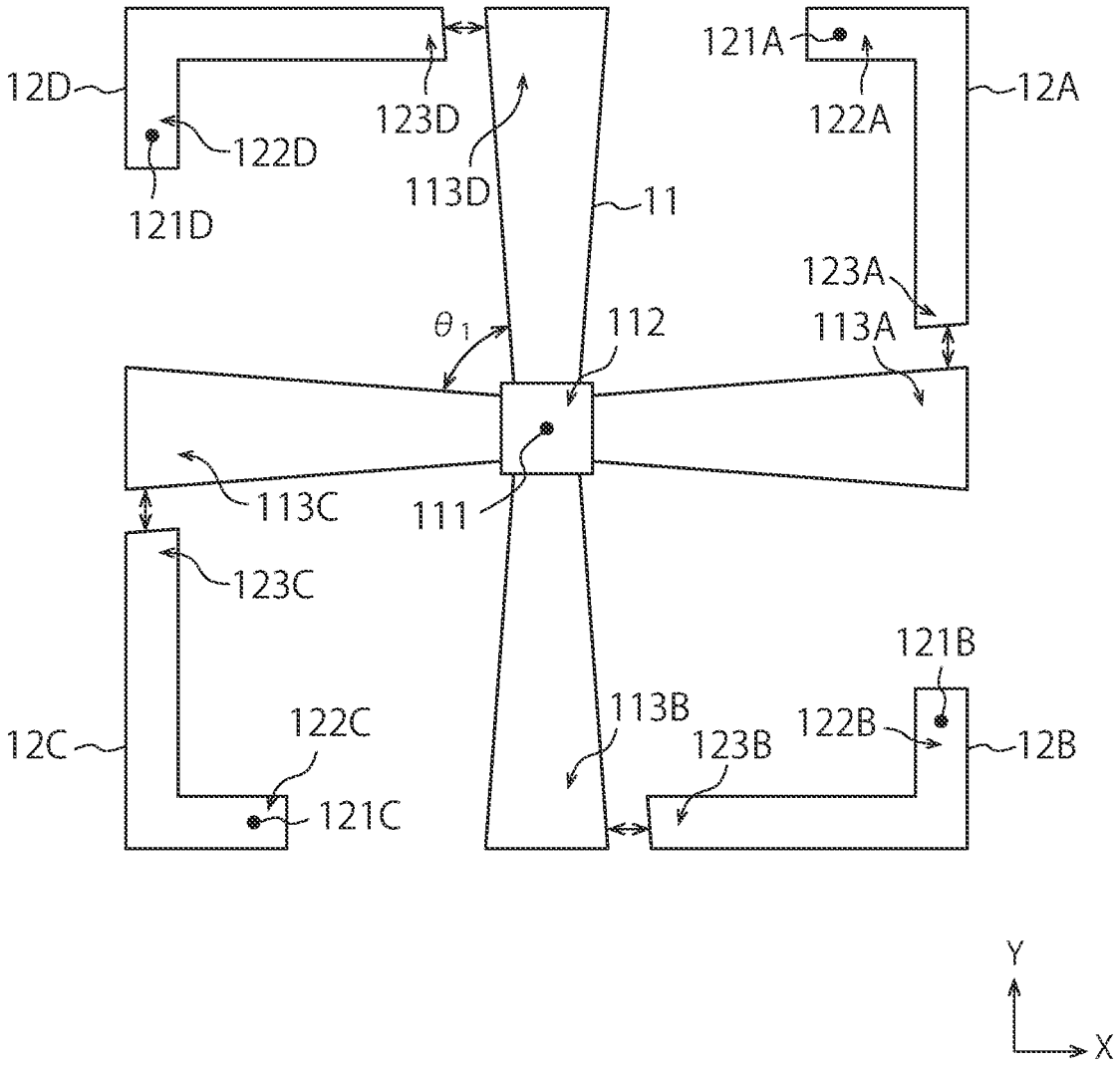
FIG. 7 is a plan view illustrating an example of a case where widths of extending regions are not constant.

Although the width of the exciting element 11 is constant in the examples shown so far, there can also be a case where the width of the exciting element 11 may increase as the distance from the central point increases. FIG. 7 is a plan view illustrating an example of a case where widths of extending regions are not constant. Here, the length of the extending region 113 in a direction perpendicular to the extending direction is defined as a "width." The width of the extending region 113 increases as the distance from the central region 112 increases. When the extending region 113 has such a shape, it is possible to provide a broader band for the radio wave characteristic of the antenna 1 compared to the case where the width of the extending region 113 is constant. Incidentally, the width of the extending region 113 at a connection with the central region 112 may be smaller than the width of the central region 112 as in the example in FIG. 7.

Although a configuration has been described so far in the examples in which the numbers of extending regions 113 and non-exciting elements 12 are four, even when the numbers of the extending regions 113 and non-exciting elements 12 is three or five or more, it is possible to generate a circularly polarized wave as long as each current flowing through the non-exciting element 12 has a component perpendicular to a current flowing through the corresponding exciting element 11. Therefore, the numbers of the extending regions 113 and non-exciting elements 12 may be three or five or more. The shape of the non-exciting elements may or may not be changed according to the number of the extending regions 113. For example, even when there are three extending region 113, the shape of the non-exciting element may be L-shaped.

Figure 8:
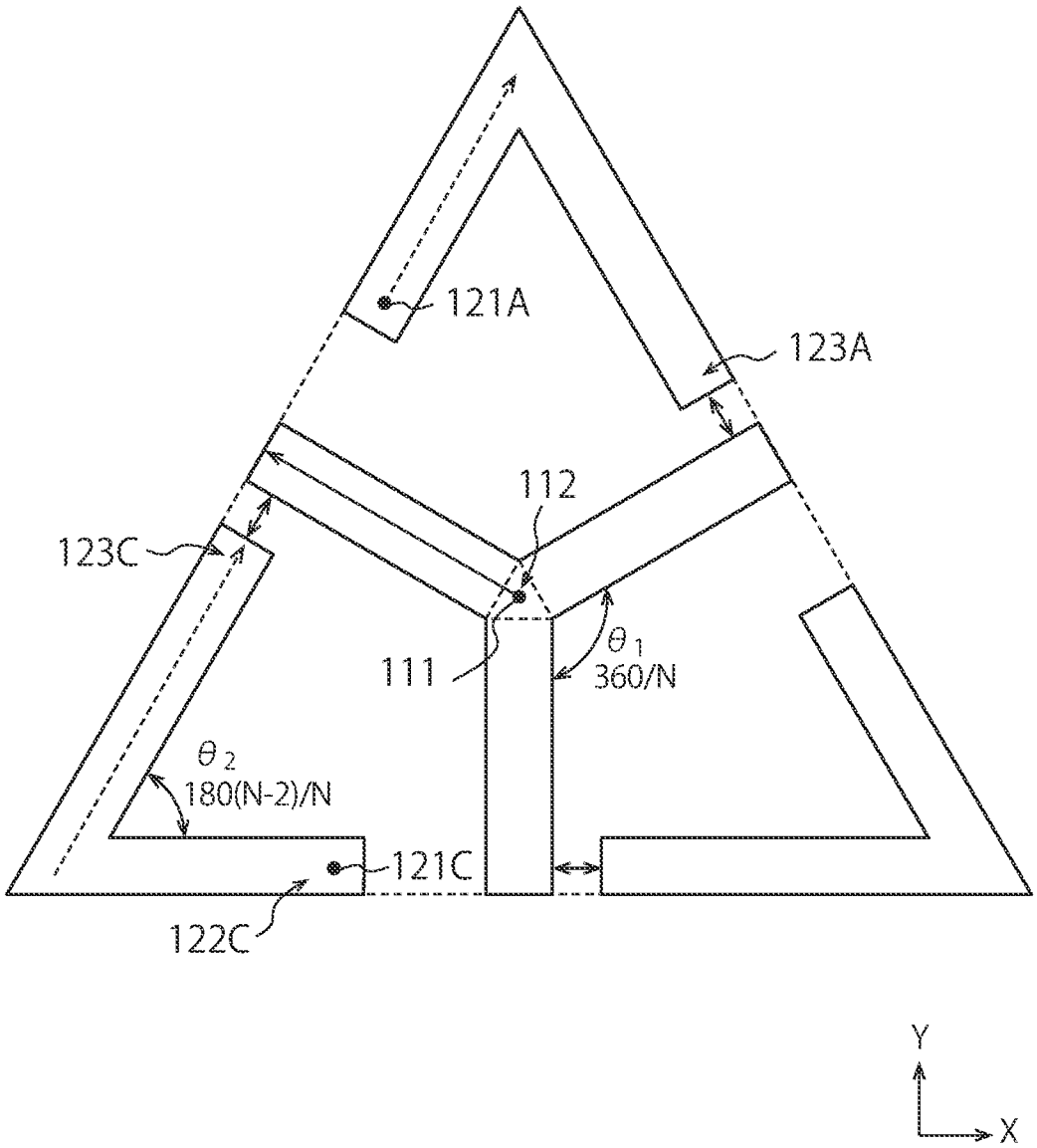
FIG. 8 is a plan view illustrating an example of configuration including three extending regions.

FIG. 8 is a plan view illustrating an example of configuration including three extending regions. In this example, the respective non-exciting elements 12 are arranged along an internal angle of an equilateral triangle centered on the feeding point 111. Incidentally, also in the example shown in FIG. 1, the respective non-exciting elements 12 are arranged in the corners of a regular tetragon centered on the feeding point 111 along frame lines of the regular tetragon. It is also shown that the current of the non-exciting element 12 shown by a dotted line is perpendicular to the current of the extending region 113 shown by a solid line. Likewise, the currents of the other extending regions 113 also include a current of the non-exciting element 12 flowing in a direction perpendicular to itself. Therefore, in the example in FIG. 8, three circularly polarized waves are generated in the respective extending regions 113 and a circularly polarized wave obtained by multiplexing these circularly polarized waves becomes a circularly polarized wave of the antenna 1. Furthermore, since the configuration in FIG. 8 is rotationally symmetric, the circularly polarized wave of the antenna 1 has null directivity.

Thus, when the number of extending regions 113 is represented by "N" (integer), the respective non-exciting elements 12 may be arranged along the respective internal angles of a regular N-sided polygon centered on the feeding point 111 to make the antenna 1 rotationally symmetric. In that case, an angle $\theta_1$ formed by each extending region 113 is expressed by 360/N and the angle ($\theta_2$ in FIG. 8) formed between a long portion and a short portion of the non-exciting element 12 is expressed by 180(N−2)/N.

As described above, the antenna 1 of the present embodiment is provided with the exciting element 11 and the plurality of non-exciting elements 12. In a plan view, the exciting element 11 includes the central region 112 having the feeding point 111 and at least three extending regions 113 extending radially from the central region 112. On the other hand, in the same plan view, each non-exciting element 12 includes the short circuit region 122 having the short circuit point 121 and the power receiving region 123. Each power receiving region 123 is located at a position where it is allowed to be capacitively coupled with the corresponding extending region 113, that is, each different extending region 113. In the same plan view, the current path from the short circuit region 122 to the power receiving region 123 in each non-exciting element 12 has a vertical component with respect to the extending direction of the corresponding extending region 113. By adopting such a configuration, the antenna 1 of the present embodiment can generate a circularly polarized wave. Since the above-described configuration is a planar configuration, it is simpler than a helical antenna for which a three-dimensional configuration is necessary. Furthermore, while the helical antenna requires two feeding points, the antenna 1 of the present embodiment needs only one feeding point. Therefore, the antenna 1 of the present embodiment can be manufactured more simply than existing helical antennas and manufacturing cost thereof can be reduced.

In the plan view, when the exciting element 11 and the plurality of non-exciting elements 12 are arranged rotationally symmetrically with respect to the feeding point 111, the antenna 1 can have null directivity with respect to the vertical direction.

Second Embodiment

Figure 9:
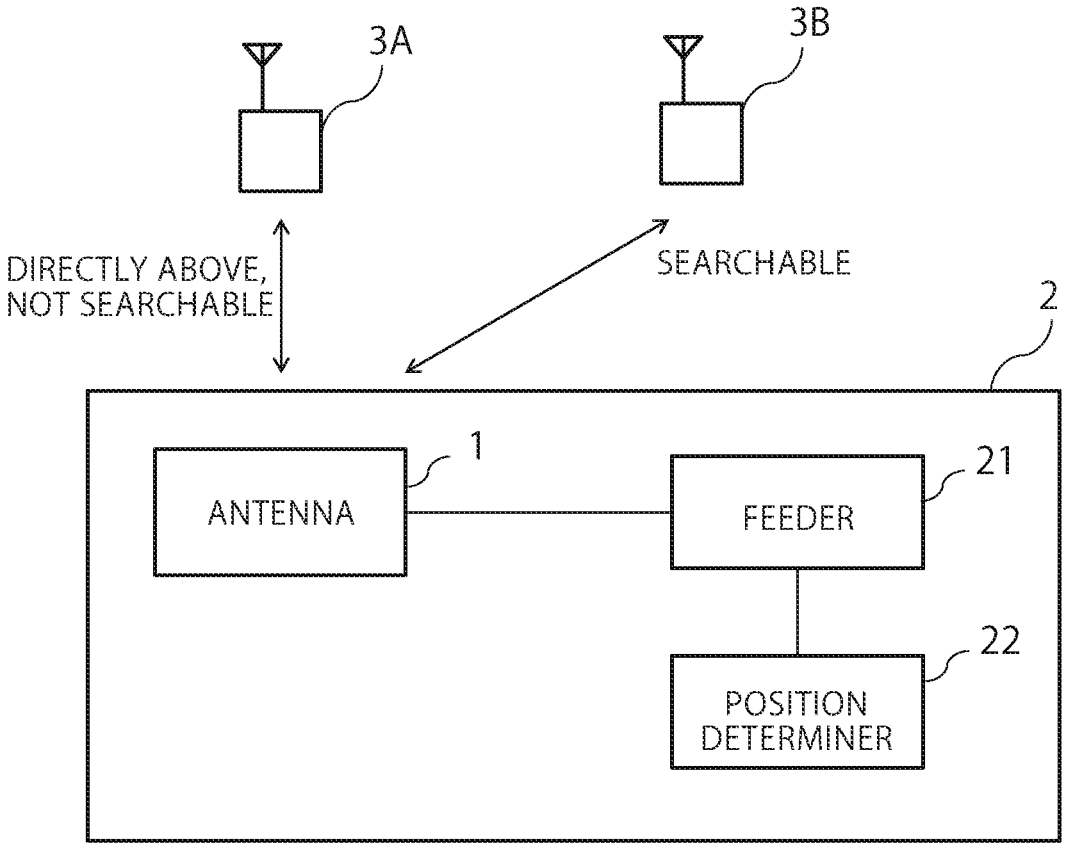
FIG. 9 is a schematic diagram of a system that determines positions of wireless communication devices using an antenna apparatus according to a second embodiment.

In the present embodiment, an antenna apparatus will be described which searches for a wireless communication device using characteristics of the antenna 1 of the first embodiment. FIG. 9 is a schematic diagram of a system that determines positions of wireless communication devices using an antenna apparatus according to a second embodiment. FIG. 9 illustrates an antenna apparatus 2 according to the second embodiment and wireless communication devices 3 (3A and 3B) to be searched. The antenna apparatus 2 is provided with the antenna 1 of the first embodiment, a feeder 21 and a position determiner 22. Description of the same matters as those of the first embodiment is omitted. The antenna 1 is placed on a horizontal surface (XY-plane) as in the example in FIG. 1.

The wireless communication devices 3 to be searched radiate radio waves at the same operating frequency as that of the antenna 1. The wireless communication devices 3 may be movable or fixed.

As shown in FIG. 5, the antenna 1 has null directivity. Therefore, the antenna 1 cannot communicate with the wireless communication device 3 located in the null direction (the wireless communication device 3A in FIG. 9). However, the antenna 1 can communicate with the wireless communication device 3 located at a position deviated from the null direction (the wireless communication device 3B in FIG. 9). The present embodiment will search for the wireless communication devices 3 using these characteristics.

Upon radiating a radio wave, the feeder 21 feeds power to the antenna 1. This allows the antenna 1 to radiate a radio wave at a predetermined frequency. Furthermore, when the antenna 1 receives a radio wave, the antenna 1 feeds the position determiner 22 with a current corresponding to the radio wave (received radio wave).

The position determiner 22 determines the position of a wireless communication device which is a transmission source of the radio wave based on at least any one of the received radio wave and wireless communication using the received radio wave. The position determiner 22 receives the current corresponding to the received radio wave via the feeder 21. Information on the received radio wave and wireless communication can be analyzed from the current. The position determiner 22 may use an existing communication circuit or the like used in the wireless communication device.

The position determiner 22 may simply determine that the object to be searched does not exist in the null direction when the radio wave from the object to be searched has been successfully received and that the object to be searched exists in the null direction when the radio wave from the object to be searched has not been successfully received. Alternatively, position determination may be performed based on the current analysis result. For example, when the current analysis result shows that the power value, intensity or the like of the radio wave exceeds a threshold, the position determiner 22 may determine that the object to be searched does not exist in the null direction. Otherwise, the position determiner 22 may determine that the object to be searched exists in the null direction. Alternatively, the position determiner 22 may also make a determination based on communication data sent from the object to be searched, for example, a communication connection result. Even when the radio wave from the object to be searched has been successfully received, if conditions are not met, the position determiner 22 may also determine that the object to be searched exists in the null direction.

Incidentally, in the present embodiment, the antenna apparatus 2 is assumed to include the antenna 1, but the antenna apparatus 2 may be separated from the antenna 1. In that case, the antenna apparatus 2 can be referred to as a determination apparatus outside the antenna 1.

Figure 10:
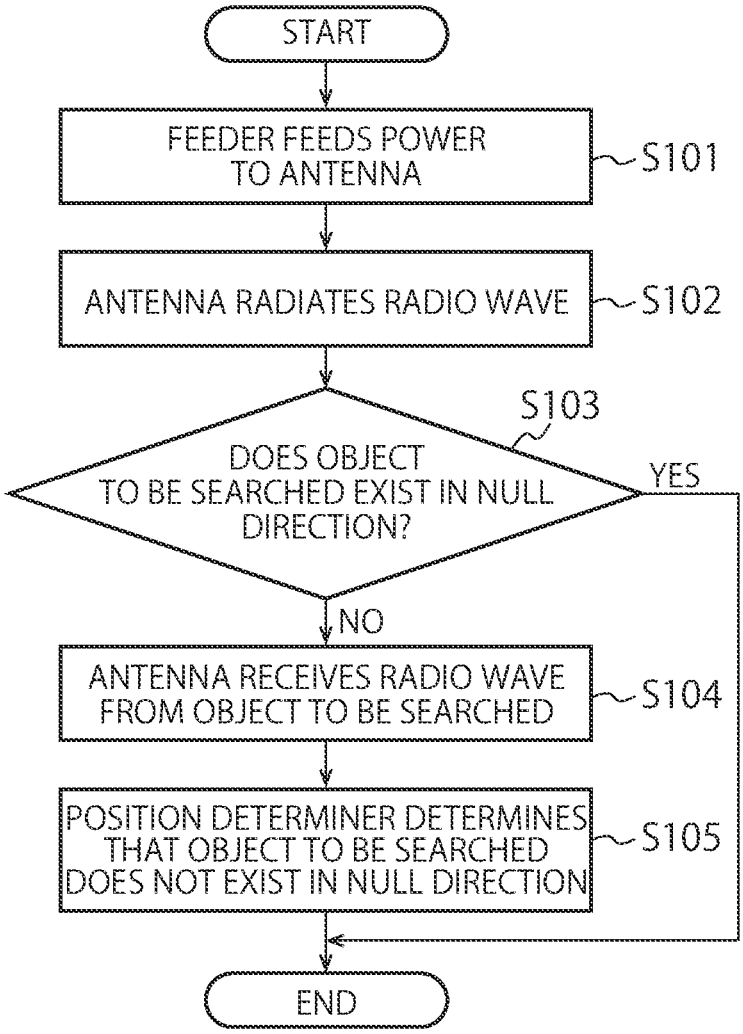
FIG. 10 is a flowchart illustrating an example of a processing flow of the antenna apparatus according to the second embodiment.

FIG. 10 is a flowchart illustrating an example of a processing flow of the antenna apparatus according to the second embodiment. It is assumed here that the antenna apparatus 2 transmits a radio wave to the wireless communication device 3 which is an object to be searched and that when the wireless communication device 3 receives the radio wave, the wireless communication device 3 sends a radio wave as a reply.

The feeder 21 feeds power to the antenna 1 (S101) and the antenna 1 radiates a radio wave (S102). When an object to be searched exists in the null direction (YES in S103), it is not possible to transmit/receive a radio wave to/from the object to be searched, and the processing ends. Incidentally, when no radio wave has been received after a lapse of a certain time, it may be determined that the object to be searched exists in the null direction or that the position thereof is unknown.

When the object to be searched does not exist in the null direction (NO in S103), a radio wave is transmitted from the object to be searched and the antenna receives the radio wave from the object to be searched (S104). The position determiner 22 then determines that the object to be searched does not exist in the null direction (S105).

There can be a case where the object to be searched does not receive the radio wave depending on the posture of the object to be searched and the radio wave. However, if the object to be searched is mounted with a general antenna 1 for linearly polarized waves, the radio wave radiated from the antenna 1 is a circularly polarized wave. Hence, the object to be searched can receive the radio wave irrespective of the posture. Therefore, when instructing the object to be searched to emit a radio wave, the antenna apparatus 2 can search for the object to be searched without changing the orientation of the antenna 1.

It has been assumed above that the antenna 1 is fixed and always radiates a radio wave in the same direction. However, it may also be possible to install the antenna 1 on a controllable and movable supporting stand, sequentially change an angle of elevation of the antenna 1 and search for the direction in which the radio wave from the object to be searched cannot be received. In that case, the position determiner 22 determines that the object to be searched exists in the direction in which the radio wave cannot be received.

As described above, in the present embodiment, it is possible to determine whether or not the wireless communication device 3, which is an object to be searched, exists in a direction having null directivity by taking advantage of the characteristic that the rotationally symmetric antenna 1 has null directivity in front.

Third Embodiment

Figure 11:
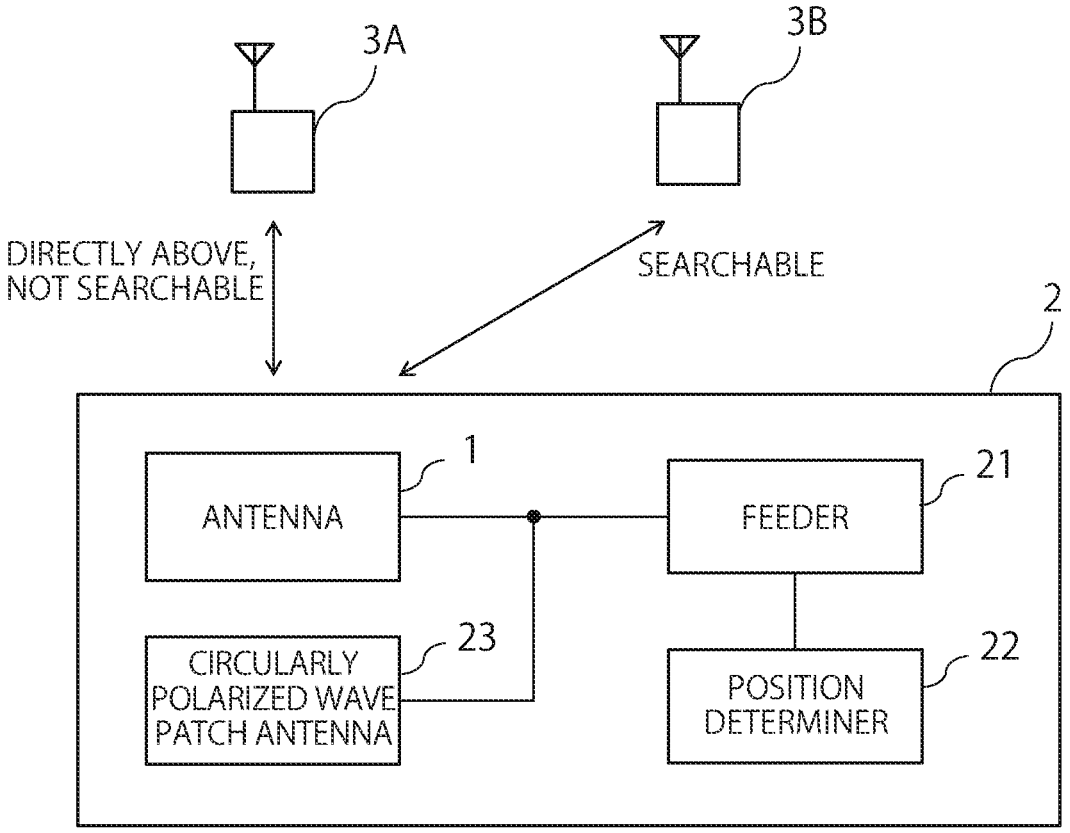
FIG. 11 is a schematic diagram of a system that determines positions of wireless communication devices using an antenna apparatus according to a third embodiment.

FIG. 11 is a schematic diagram of a system that determines positions of wireless communication devices using an antenna apparatus according to a third embodiment. The antenna apparatus 2 of the present embodiment is further provided with a circularly polarized wave patch antenna 23 (second antenna) compared with the antenna apparatus 2 of the second embodiment. The antenna apparatus 2 of the present embodiment performs a search using both the antenna 1 and the circularly polarized wave patch antenna 23. More specifically, the antenna apparatus 2 confirms that the target wireless communication devices 3 exists using the circularly polarized wave patch antenna 23 and then searches for the position of the wireless communication devices 3 using the antenna 1. The search accuracy of the wireless communication devices 3 is thereby improved. Description of the same matters as those of the embodiments described so far is omitted.

To switch the antenna 1 to be used, the feeder 21 of the present embodiment switches the feeding destination. Incidentally, instead of the feeder 21 switching the feeding destination, a switcher may be provided which switches the path of a current from the feeder 21. The switching may be performed manually. Therefore, the switcher may be a physical switch. Alternatively, after one antenna 1 makes a position determination, switching may be performed automatically. Therefore, the switcher may be implemented by software that controls the feeder 21. Alternatively, the antenna apparatus 2 may be provided with two feeders 21 that feed power to the antenna 1 and the circularly polarized wave patch antenna 23 respectively, the switcher switches between conduction or no conduction to the respective feeder 21 so that power is fed to one of the antenna 1 and the circularly polarized wave patch antenna 23.

The circularly polarized wave patch antenna 23 is a patch antenna that includes a feeding point 231 at a position other than the center in the same plan view as that of the first embodiment and has a shape without two of four corners located on the diagonals of a rectangle. The patch antenna in such a shape is known to be able to generate a circularly polarized wave. However, the circularly polarized wave patch antenna 23 does not have any null directivity.

In the present embodiment, the circularly polarized wave patch antenna 23 is disposed so as to radiate a circularly polarized wave in the same direction as the direction of the circularly polarized wave by the antenna 1. That is, the circularly polarized wave patch antenna 23 radiates the circularly polarized wave in the null direction of the antenna 1. For example, the circularly polarized wave patch antenna 23 and the antenna 1 are arranged so as to overlap at least partially. Incidentally, for reasons related to the structure or the like, there can also be cases where the circularly polarized wave patch antenna 23 and the antenna 1 cannot be arranged so as to overlap each other. In such a case, the circularly polarized wave patch antenna 23 and the antenna 1 only need to be arranged in proximity to each other. For example, the circularly polarized wave patch antenna 23 may be arranged adjacent to the antenna 1.

Figure 12:
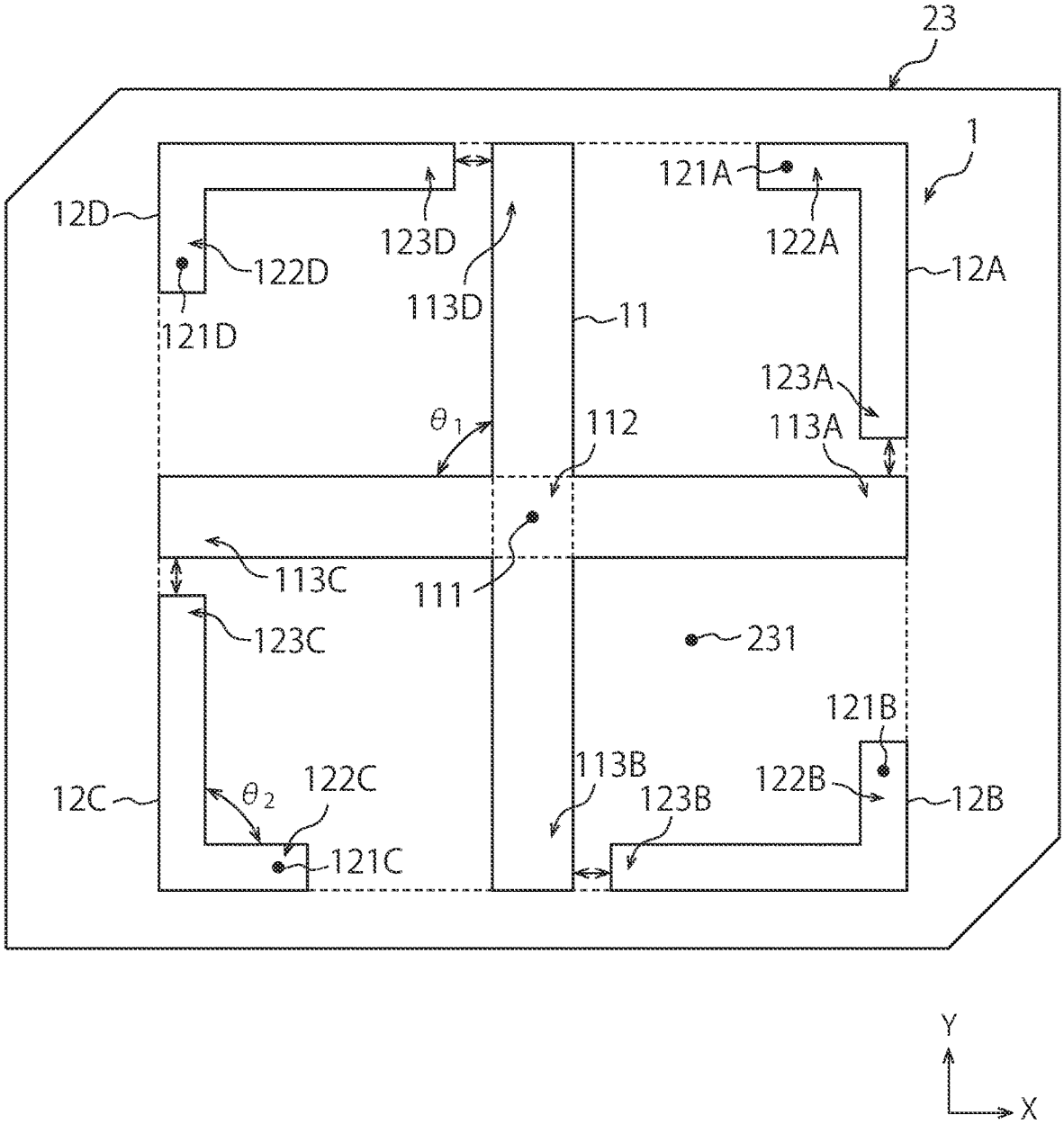
FIG. 12 is a plan view illustrating an example of arrangement of a circularly polarized wave patch antenna.

FIG. 12 is a plan view illustrating an example of an arrangement of the circularly polarized wave patch antenna. As shown in FIG. 11, in the plan view, the circularly polarized wave patch antenna 23 and the antenna 1 are arranged so as to overlap at least partially. For example, when the antenna apparatus 2 is manufactured using a printed circuit board as shown in FIG. 2, it is possible to: laminate first and second insulators; arrange the antenna 1 on a top surface of one of the first and second insulators; and arrange the circularly polarized wave patch antenna 23 on a top surface of the remaining one. Incidentally, any one of the circularly polarized wave patch antenna 23 and the antenna 1 may be arranged above the other. Alternatively, the conductor grounding plate 14 shown in FIG. 2 may be replaced by the circularly polarized wave patch antenna 23. In that case, the non-exciting element 12 is connected to the circularly polarized wave patch antenna 23, thereby short-circuited and the circularly polarized wave patch antenna 23 plays a role as a ground conductor for the exciting element 11 and the non-exciting element 12 at a wireless frequency as well.

Incidentally, in FIG. 12, the circularly polarized wave patch antenna 23 is greater than the region including the antenna 1 (rectangular frame shown by a dotted line), but the circularly polarized wave patch antenna 23 may be equal to or smaller than the region including the antenna 1.

Although the position determiner 22 of the present embodiment determines the position of a wireless communication device in the same way as in the second embodiment, when making such a determination, the position determiner 22 determines the position of a wireless communication device by further taking into consideration at least one of a received radio wave of the circularly polarized wave patch antenna 23 and wireless communication using the received radio wave. For example, unlike the second embodiment, the position determiner 22 may determine that an object to be searched exists in the null direction only when the circularly polarized wave patch antenna 23 confirms the existence of the object to be searched.

Figure 13:
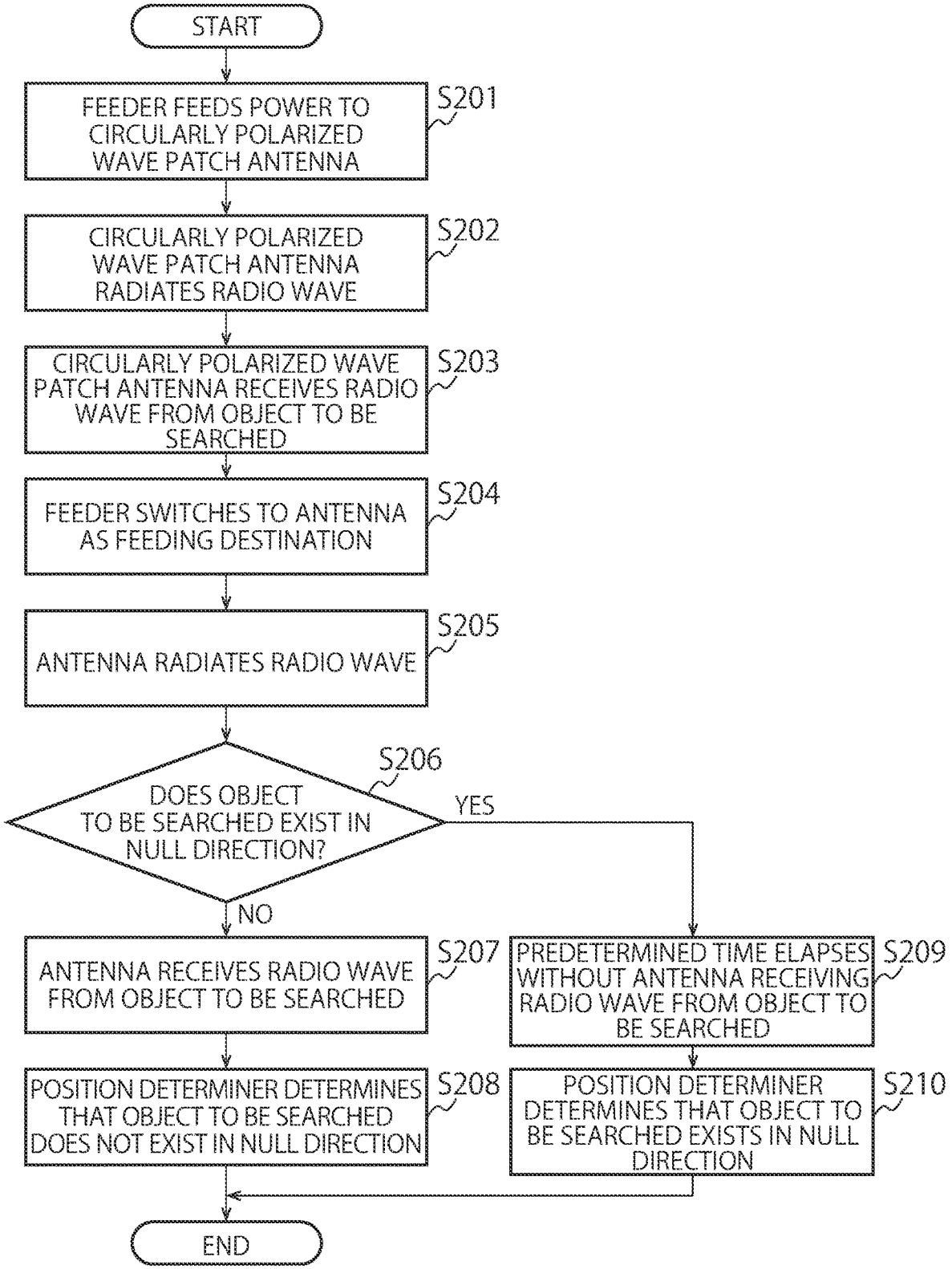
FIG. 13 is a flowchart illustrating an example of a processing flow of the antenna apparatus according to the third embodiment.

FIG. 13 is a flowchart illustrating an example of a processing flow of the antenna apparatus according to the third embodiment. The feeder 21 feeds power to the circularly polarized wave patch antenna 23 (S201) and the circularly polarized wave patch antenna 23 radiates a radio wave (S202). Since the circularly polarized wave patch antenna has no null directivity, the object to be searched receives the radio wave from the circularly polarized wave patch antenna 23 no matter in which direction the object to be searched exists. Therefore, a radio wave is transmitted from the object to be searched and the circularly polarized wave patch antenna 23 receives the radio wave from the object to be searched (S203).

Next, the feeder switches to the antenna 1 as the feeding destination and feeds power thereto (S204), and the antenna radiates a radio wave (S205). When the object to be searched does not exist in the null direction (NO in S206), the radio wave is transmitted from the object to be searched and the antenna receives the radio wave from the object to be searched (S207). The position determiner 22 then determines that the object to be searched does not exist in the null direction (S208).

On the other hand, when the object to be searched exists in the null direction (YES in S206), it is not possible to transmit/receive a radio wave to/from the object to be searched, and so a certain time elapses without receiving any radio wave from the object to be searched (S209). In response to this, the position determiner 22 determines that the object to be searched does not exist in the null direction (S210).

Thus, the position determiner 22 of the present embodiment determines the position of the object to be searched based on at least one of a radio wave received by the antenna 1 (first radio wave) and wireless communication using the radio wave (first wireless communication), and at least one of a radio wave received by the circularly polarized wave patch antenna 23 (second radio wave) and wireless communication using the radio wave (second wireless communication). Since the existence of the object to be searched is confirmed using the circularly polarized wave patch antenna 23, when the antenna 1 cannot receive the radio wave from the object to be searched, there is a high possibility that the object to be searched will exist in the null direction. The possibility of erroneous determination can be thereby suppressed.

As described above, according to the present embodiment, a patch antenna is also used to search for the wireless communication device 3. The decision accuracy can thereby be improved.

The feeder 21 and the position determiner 22 may also be implemented by dedicated electronic circuitry (that is, hardware) such as an IC (integrated circuit) mounted with a processor, memory or the like. Alternatively, they may also be implemented by executing software (program). For example, processing of the feeder 21 and the position determiner 22 may be implemented by using a general-purpose computer apparatus as basic hardware and causing a processor (processing circuit) such as a central processing unit (CPU) mounted on the computer apparatus to execute the program.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

The invention claimed is:

1. An antenna comprising:

an exciting element including, in a plan view, a central region having a feeding point and at least three extending regions that extend radially from the central region; and a plurality of non-exciting elements each including, in the plan view, a short circuit region having a short circuit point and a power receiving region located at a position where it is allowed to be capacitively coupled with corresponding one of the extending regions, wherein in the plan view, a current path from the short circuit region to the power receiving region in each of the non-exciting elements has a vertical component with respect to the extending direction of the corresponding one of the extending regions.

2. The antenna according to claim 1, wherein the plurality of non-exciting elements have a non-linear shape in the plan view.

3. The antenna according to claim 1, wherein the exciting element and each of the non-exciting elements are arranged rotationally symmetrically with respect to the feeding point in the plan view.

4. The antenna according to claim 1, further comprising:

a conductor grounding plate; and an insulator laminated on the conductor grounding plate, wherein the exciting element and the non-exciting elements are formed on a top surface of the insulator.

5. The antenna according to claim 1, wherein in the plan view, the non-exciting elements have an arcuate shape.

6. The antenna according to claim 1, wherein in the plan view, the non-exciting elements have an L-shape.

7. The antenna according to claim 1, wherein when the number of the extending regions is represented by N (integer), the respective non-exciting elements are arranged along each internal angle of a regular N-sided polygon centered on the feeding point or along a circumference centered on the feeding point.

8. The antenna according to claim 1, wherein in the plan view, the widths of the extending regions in a direction orthogonal to the extending direction increases as the distance from the central region increases.

9. The antenna according to claim 1, further comprising a second antenna configured to radiate a circularly polarized wave in a null direction of the antenna, wherein in the plan view, the second antenna at least partially overlaps a region including the exciting element and the plurality of non-exciting elements.

10. An antenna apparatus comprising:

the antenna according to claim 1; and electronic circuitry configured to determine a position of a wireless communication device, which is a transmission source of a first radio wave received by the antenna based on at least one of the first radio wave and first wireless communication using the first radio wave.

11. An antenna apparatus comprising:

the antenna according to claim 1;

a second antenna configured to radiate a circularly polarized wave in a null direction of the antenna; and electronic circuitry configured to determine a position of a wireless communication device, which is a transmission source of a first radio wave received by the antenna and a second radio wave received by the second antenna based on: at least one of the first radio wave and first wireless communication using the first radio wave; and at least one of the second radio wave and second wireless communication using the second radio wave.

12. The antenna apparatus according to claim 11, wherein in the plan view, the second antenna at least partially overlaps a region including the exciting element and the plurality of non-exciting elements.

* * * * *